US012071597B2

(12) United States Patent
El-Bahi et al.

(10) Patent No.: US 12,071,597 B2
(45) Date of Patent: Aug. 27, 2024

(54) DEAERATION OF A LUBRICANT COMPOSITION

(71) Applicant: TOTAL MARKETING SERVICES, Puteaux (FR)

(72) Inventors: Hakim El-Bahi, Solaize (FR); Goulven Bouvier, Solaize (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 17/641,213

(22) PCT Filed: Sep. 11, 2020

(86) PCT No.: PCT/FR2020/051572

§ 371 (c)(1),
(2) Date: Mar. 8, 2022

(87) PCT Pub. No.: WO2021/048506

PCT Pub. Date: Mar. 18, 2021

(65) Prior Publication Data

US 2024/0052257 A1 Feb. 15, 2024

(30) Foreign Application Priority Data

Sep. 12, 2019 (FR) ..... 1910040

(51) Int. Cl.
*C10M 155/02* (2006.01)
*C10N 20/02* (2006.01)
(Continued)

(52) U.S. Cl.
CPC .... *C10M 155/02* (2013.01); *C10M 2229/046* (2013.01); *C10M 2290/00* (2013.01);
(Continued)

(58) Field of Classification Search
CPC ..... C10M 155/02; C10M 2229/046; C10M 2290/00; C10N 2020/02; C10N 2030/54; C10N 2040/02
See application file for complete search history.

(56) References Cited

U.S. PATENT DOCUMENTS 3,887,487 A 6/1975 Camp
2006/0264339 A1* 11/2006 Devlin ..... C10M 165/00 508/273
(Continued)

FOREIGN PATENT DOCUMENTS

CN 1064884 9/1992
CN 1066662 12/1992
(Continued)

OTHER PUBLICATIONS

Gauthier Leprince et al, "Influence of Aerated Lubricants on Gear Churning Losses—An Engineering Model", Tribology Transactions, US, (Nov. 1, 2011), vol. 54, No. 6, doi:10.1080/10402004.2011.597542, ISSN 1040-2004, pp. 929-938, XP055697502 [YD] 1,7 * abstract *.

*Primary Examiner* — Ellen M McAvoy
(74) *Attorney, Agent, or Firm* — DUANE MORRIS LLP; Gregory M. Lefkowitz; Brandon A. Chan

(57) ABSTRACT

The present invention concerns the use of at least one polyorganosiloxane to release air from a lubricant composition comprising at least one base oil, when lubricating at least one moving part of an electric or hybrid vehicle.

20 Claims, 3 Drawing Sheets

(51) Int. Cl.
*C10N 30/00* (2006.01)
*C10N 40/02* (2006.01)

(52) U.S. Cl.
CPC ..... *C10N 2020/02* (2013.01); *C10N 2030/54* (2020.05); *C10N 2040/02* (2013.01)

(56) References Cited

U.S. PATENT DOCUMENTS

| | | | | |
|---|---|---|---|---|
| 2009/0005273 | A1* | 1/2009 | Swartele | C10M 171/02 508/110 |
| 2009/0036338 | A1* | 2/2009 | Hee | C10M 107/02 508/591 |
| 2014/0018267 | A1* | 1/2014 | Loop | C10M 155/02 508/206 |
| 2017/0121629 | A1* | 5/2017 | Xu | B01D 19/0404 |
| 2019/0390132 | A1* | 12/2019 | Tatsumi | B01D 19/0409 |
| 2020/0157454 | A1* | 5/2020 | Seemeyer | C10M 155/02 |
| 2020/0199477 | A1* | 6/2020 | Blumenfeld | C10M 169/041 |
| 2020/0339902 | A1* | 10/2020 | Blumenfeld | C10M 111/04 |
| 2021/0325360 | A1* | 10/2021 | Wang | G01N 33/2841 |
| 2022/0204884 | A1* | 6/2022 | Takagi | C10M 155/02 |

FOREIGN PATENT DOCUMENTS

| | | |
|---|---|---|
| EP | 1634940 | 3/2006 |
| JP | 2014177608 | 9/2014 |

* cited by examiner

[Fig. 1]
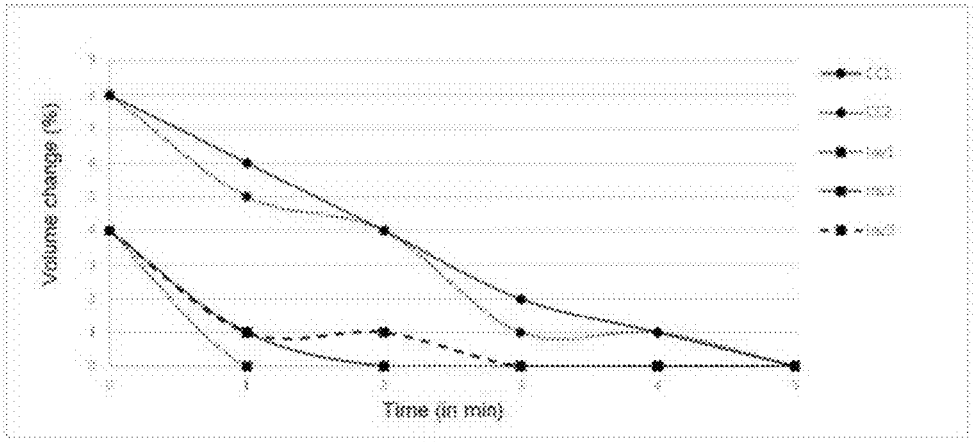
[Fig. 2]
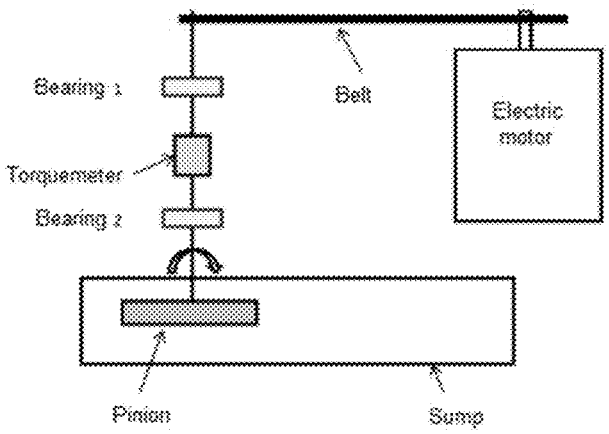

[Fig. 3]
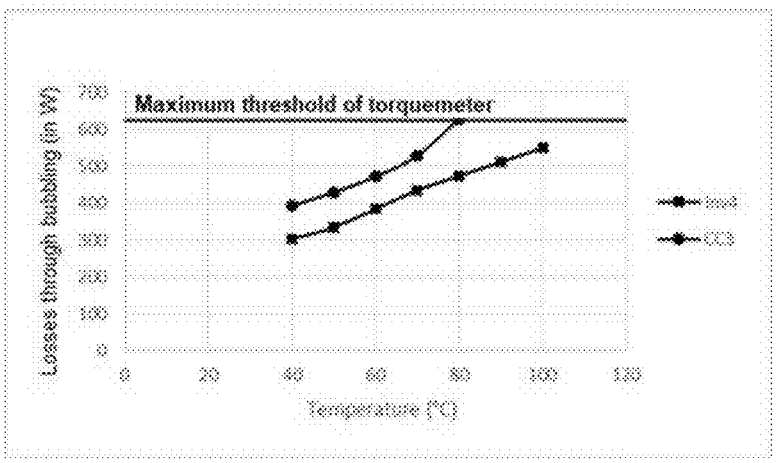
[Fig. 4]
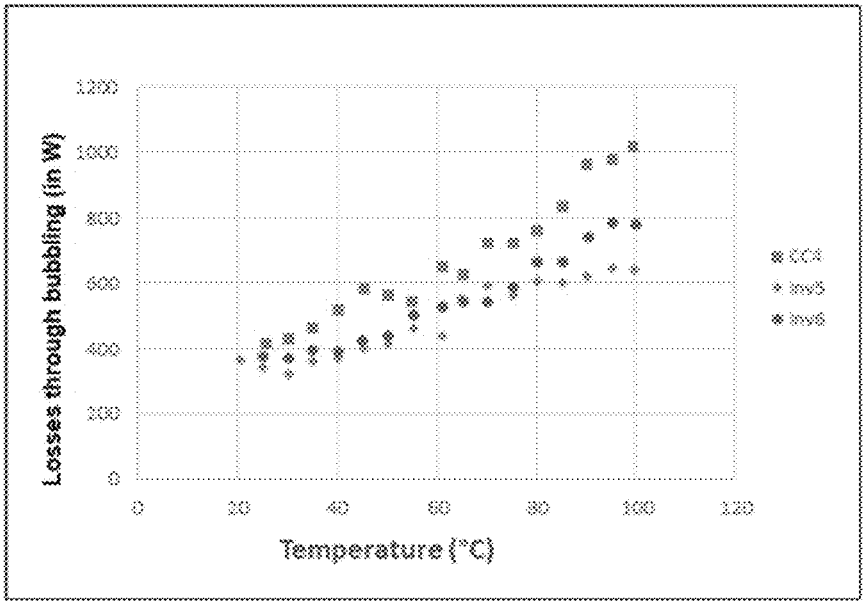

[Fig. 5]
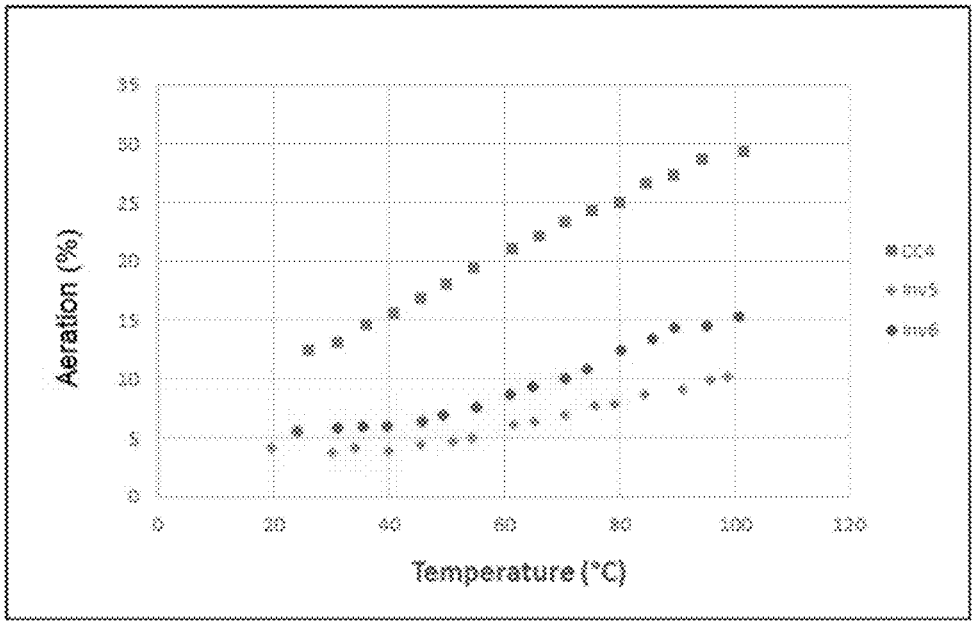

DEAERATION OF A LUBRICANT COMPOSITION

CROSS-REFERENCE TO RELATED APPLICATIONS

This application is a § 371 national stage entry of International Application No. PCT/FR2020/051572, filed Sep. 11, 2020, which claims priority to French Patent Application No. 1910040, filed Sep. 12, 2019, the entire contents of which are incorporated herein by reference.

TECHNICAL FIELD OF THE INVENTION

The present invention relates to the field of lubricant compositions for vehicles, in particular for electric or hybrid vehicles. It more particularly concerns release of air from a lubricant composition to reduce losses through bubbling and to increase the yield of a vehicle, in particular an electric or hybrid vehicle.

STATE OF THE ART

Lubricant compositions are used to protect and lubricate contacting surfaces and can also be used to transmit power.

In general, it is necessary in vehicles to use lubricant compositions, also called «lubricants» for the chief purpose of reducing friction forces between the different parts of the vehicle propulsion system, in particular between moving metal parts inside engines. These lubricant compositions are additionally efficient in preventing early wear and even damage of these parts, in particular to the surface thereof.

A vehicle propulsion system generally operates with high rotation speeds. The lubricant composition used must therefore maintain good performances and good properties even when subjected to high rotation speeds.

In particular, air may enter the core of the lubricant composition when in service in a vehicle, in particular at parts subjected to high rotation speeds. A distinction must particularly be made between the phenomenon of aeration of a lubricant composition and foaming of a lubricant composition.

In particular, aeration of a lubricant composition can be the cause of losses through bubbling of high-speed mechanical transmissions. These losses through bubbling can also be the cause of losses of vehicle yield. Underlying these losses is the phenomenon of aeration of the oil which translates as entry of air into the whole volume of the lubricant fluid. Conversely, the phenomenon of foaming is characterized by inclusion of air solely on the surface i.e. at the lubricant fluid/air interface. As a result, during the turbulent phase observed in the propulsion system, this air integrated in the total volume of the fluid hinders optimal yield of the vehicle.

Document EP1634940 discloses the use of grafted polysiloxane as oil defoaming and de-aerating agent.

Document FR2170827 discloses the use of an organosilicon compound in liquid compounds to remove gas bubbles.

Document CN1066662 discloses a method for preparing an antifoaming agent of octamethylcyclotetrasiloxane type.

Document CN1064884 discloses the combined use of a dimethylsiloxane and an acrylate copolymer to reduce bubbles in an oil.

Document WO2015187440 discloses the use of a defoaming agent comprising a silicone oil and silica particles.

Document LEPRINCE ET AL «Influence of aerated lubricants on gear churning losses—an engineering model», Tribology Transactions, Vol 54, No 6, 1 Nov. 2011. pp 929-938 examines parameters impacting losses through bubbling.

None of these six documents suggests the use of a polyorganosiloxane to release air from a lubricant composition comprising at least one base oil, when lubricating at least one moving part in a propulsion system of an electric or hybrid vehicle. Yet these types of vehicles involve specific, even extreme conditions in terms of stresses (in particular high rotation speeds) requiring high-performing air release additives.

The present invention sets out precisely to provide an additive allowing air release from a lubricant composition, in particular at the turbulent phase i.e. when it is subjected to strong rotation speeds, for example when lubricating transmissions of electric or hybrid vehicles.

SUMMARY OF THE INVENTION

More specifically, the present invention concerns the use of at least one polyorganosiloxane to release air from a lubricant composition comprising at least one base oil, when lubricating at least one moving part of a propulsion system of an electric or hybrid vehicle.

In one embodiment, the lubricant composition displays an initial change in air volume in the lubricant composition, measured according to standard NF ISO 12152, lower than 6%, preferably lower than 5%.

In one embodiment, said polyorganosiloxane is selected from among polydimethylsiloxanes.

In one embodiment, the lubricant composition comprises from 0.0005 to 2% by weight, preferably from 0.001 to 1.5% by weight, more preferably from 0.05 to 1% by weight of polyorganosiloxane(s), relative to the total weight of the lubricant composition.

In one embodiment, the base oil(s) have kinematic viscosity at 100° C. ranging from 4 to 50 $mm^2/s$.

In one embodiment, the lubricant composition comprises at least 70% by weight, preferably 80 to 99% by weight, more preferably 85 to 95% by weight of one or more base oils relative to the total weight of the lubricant composition.

In one embodiment, the lubricant composition is used to reduce losses through bubbling in a lubricating system of a vehicle, preferably an electric or hybrid vehicle.

In one embodiment, the lubricant composition is used to reduce losses through bubbling.

In one embodiment, said at least one moving part is a part rotating at a speed ranging from 1000 to 15000 rpm, preferably ranging from 1300 to 12000 rpm, more preferably from 5000 to 10000 rpm.

In one embodiment, the vehicle is an electric or hybrid vehicle and the lubrication system comprises at least one element from among the bearings positioned between the rotor and stator of an electric motor, and the transmission, of an electric or hybrid vehicle.

By «propulsion system» in the present invention, it is meant to designate a system comprising the mechanical parts required for propelling a vehicle. For an electric vehicle, the propulsion system therefore particularly encompasses an electric motor, or the rotor-stator assembly of the power electronics (dedicated to speed regulation), a transmission also called a reducer and a battery.

By «electric vehicle» in the present invention it is meant to designate a vehicle comprising an electric motor as sole propulsion means, contrary to a hybrid vehicle which comprises a combustion engine and an electric motor as combined propulsion means.

Other characteristics, variants and advantages of implementation of the invention will become better apparent on reading the following description and nonlimiting examples given to illustrate the invention.

In the remainder of the text the expressions «between . . . and . . . », «ranging from . . . to . . . » and «varying from . . . to . . . » are equivalent and are meant to include the limits unless otherwise stated.

Unless otherwise indicated, the expression «comprising a» is to be understood as «comprising at least one».

BRIEF DESCRIPTION OF THE FIGURES

FIG. 1 shows changes in air dispersion in the lubricant composition (expressed in %) as a function of time (expressed in minutes).

FIG. 2 illustrates the test rig for examining losses through bubbling for Example 2.

FIG. 3 illustrates monitoring of losses through bubbling (expressed in W) as a function of temperature (expressed in ° C.).

FIG. 4 illustrates monitoring of losses through bubbling (expressed in W) as a function of temperature (expressed in ° C.).

FIG. 5 shows aeration (expressed in %) of the compositions as a function of temperature (expressed in ° C.).

DETAILED DESCRIPTION OF THE INVENTION

The present invention concerns the use of at least one polyorganosiloxane to release air from a lubricant composition comprising at least one base oil, when lubricating at least one moving part of a vehicle.

Polyorganosiloxane

In one embodiment of the invention, the polyorganosiloxane(s) are selected from among polyalkylsiloxanes in which the alkyl groups typically have 1 to 24 carbon atoms, preferably 1 to 12 carbon atoms, more preferably 1 to 6 carbon atoms.

In one embodiment of the invention, the polyorganosiloxane(s) used in the invention are selected from among polydimethylsiloxanes.

In one embodiment of the invention, the polyorganosiloxane(s), preferably the polyalkylsiloxane(s) used in the invention are added to the lubricant composition so that the resulting lubricant composition has an initial change in air volume, measured according to standard NF ISO 12152 (2012), lower than or equal to 6%, preferably lower than or equal to 5%.

In one embodiment of the invention, the polyorganosiloxane(s) used in the invention have kinematic viscosity at 25° C. ranging from 1000 to 100000 $mm^2/s$, preferably from 5000 to 75000 $mm^2/s$, more preferably from 10000 to 50000 $mm^2/s$.

In one embodiment, the polyorganosiloxane(s) used in the invention are selected from among linear polyorganosiloxanes, cyclic polyorganosiloxanes, cyclic linear polyorganosiloxanes, and mixtures thereof.

In one embodiment, the polyorganosiloxane(s) are used in the invention in a mixture with silica, typically in a content such that the silica content ranges from 0.001 to 1.5% by weight, preferably from 0.002 to 1% by weight relative to the total weight of the lubricant composition (obtained after addition of the polyorganosiloxane(s) and silica).

The polyorganosiloxane(s) used in the invention are compounds initially known for their antifoaming property and are commercially available.

In one preferred embodiment of the invention, the polyorganosiloxane(s) represent from 0.0005 to 2% by weight, preferably from 0.001 to 1.5% by weight, more preferably from 0.002 to 1% of the total weight of the lubricant composition.

Base Oils

A lubricant composition used in the invention may therefore comprise one or more base oils.

These base oils can be selected from among base oils conventionally used in the field of lubricant oils, such as mineral, synthetic or natural, animal or vegetable oils, or mixtures thereof.

They may be a mixture of several base oils e.g. a mixture of two, three or four base oils.

The base oils of the lubricant compositions under consideration in the invention can particularly be oils of mineral or synthetic origin belonging to Groups I to V of the classes defined in the API classification (or the equivalents thereof in the ATIEL classification) given in Table 1 below, or mixtures thereof.

TABLE 1

| | Saturates content | Sulfur content | Viscosity Index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |
| Group IV | Polyalphaolefins (PAOs) | | |
| Group V | Esters and other bases not included in Groups I to IV | | |

Mineral base oils include all types of base oils obtained by atmospheric and vacuum distillation of crude petroleum, followed by refining operations such as solvent extraction, deasphalting, solvent dewaxing, hydrotreatment, hydrocracking, hydroisomerization and hydrofinishing.

Mixtures of Possibly Biosourced Synthetic and Mineral Oils can Also be Employed

In general, there is no limitation as to the use of different base oils to prepare the compositions used in the invention, other than that they must have properties, in particular in terms of viscosity, viscosity index or oxidation stability, that are adapted for use in propulsion systems of an electric or hybrid vehicle.

The base oils of the compositions used in the invention can also be selected from among synthetic oils such as some esters of carboxylic acids and alcohols, polyalphaolefins (PAOs), and polyalkylene glycols (PAGs) obtained by polymerization or copolymerization of alkylene oxides having 2 to 8 carbon atoms, in particular 2 to 4 carbon atoms.

The PAOs used as base oils are obtained for example from monomers having 4 to 32 carbon atoms, e.g. from octene or decene. The weight average molecular weight of the PAO may vary fairly widely. Preferably, the weight average molecular weight of the PAO is lower than 600 Da. The weight average molecular weight of the PAO may also range from 100 to 600 Da, from 150 to 600 Da, or further from 200 to 600 Da.

Advantageously, the base oil(s) of the composition used in the invention are selected from among polyalphaolefins (PAOs), polyalkylene glycols (PAGs) and the esters of carboxylic acids and alcohols.

In one alternative embodiment, the base oil(s) of the composition used in the invention can be selected from among the base oils in Group II or III.

It is within the reach of persons skilled in the art to adjust the content of base oil to be used in a composition conforming to the invention.

One lubricant composition of the invention under consideration may comprise at least 70% by weight of base oil(s) relative to total weight, preferably 75 to 99% by weight of base oil(s), more preferably 80 to 98% by weight of base oil(s), further preferably 85 to 95% by weight of base oil(s) relative to total weight.

Additional Additives

A lubricant composition suitable for the invention may also comprise all types of additives adapted for use in a lubricant for the propulsion system of a vehicle, preferably an electric or hybrid vehicle.

Said additives, known to skilled persons in the field of lubrication and/or cooling of propulsion systems of electric or hybrid vehicles, can be selected from among friction modifiers, detergents, anti-wear additives, extreme pressure additives, dispersants, antioxidants, pour point depressants, antifoaming agents, and mixtures thereof.

Advantageously, a composition suitable for the invention comprises at least one additional additive selected from among friction modifiers, viscosity index improvers, detergents, extreme pressure additives, dispersants, antioxidants, pour point depressants, antifoaming agents and mixtures thereof.

These additives can be added alone and/or in the form of a mixture similar to commercial lubricant formulas already commercially available for vehicle engines having a performance level such as defined by the European Automobile Manufacturers Association (ACEA) or the American Petroleum Institute (API), well known to skilled persons.

A lubricant composition suitable for the invention may comprise at least one friction modifying additive. The friction modifier can be selected from among a compound providing metal elements and an ash-free compound. Among the compounds providing metal elements, mention can be made of complexes of transition metals such as Mo, Sb, Sn, Fe, Cu, Zn of which the ligands can be hydrocarbon compounds comprising oxygen, nitrogen sulfur or phosphorus atoms. Ash-free friction modifying additives are generally of organic origin and can be selected from among the monoesters of fatty acids and polyols, alkoxylated amines, alkoxylated fatty amines, fatty epoxides, fatty borate epoxides, glycerol fatty acid esters or fatty amines. In the invention, the fatty compounds comprise at least one hydrocarbon group having 10 to 24 carbon atoms.

A lubricant composition suitable for the invention may comprise from 0.01 to 2% by weight or 0.01 to 5% by weight, preferably 0.1 to 1.5% by weight or 0.1 to 2% by weight of friction modifying additive relative to the total weight of the composition.

A lubricant composition used in the invention may comprise at least one antioxidant additive.

The antioxidant additive generally allows delayed degradation of the composition in service. This degradation can particularly translate as the formation of deposits, the presence of sludge or an increase in the viscosity of the composition.

Antioxidant additives act in particular as radical scavengers or hydroperoxide decomposers. Among commonly employed antioxidant additives, mention can be made of antioxidant additives of phenolic type, antioxidant additives of amine type, sulfur-phosphorus antioxidant additives. Some of these antioxidant additives e.g. sulfur-phosphorus antioxidant additives can generate ash. Phenolic antioxidant additives can be ash-free or in the form of neutral or basic metal salts. Antioxidant additives can particular be selected from among sterically hindered phenols, sterically hindered phenol esters, and sterically hindered phenols comprising a thioether bridge, diphenylamines, diphenylamines substituted by at least one $C_1$-$C_{12}$ alkyl group, N,N'-dialkyl-aryl-diamines and mixtures thereof.

Preferably, in the invention, the sterically hindered phenols are selected from among compounds comprising a phenol group in which at least one vicinal carbon of the carbon carrying the alcohol function is substituted by at least one $C_1$-$C_{10}$ alkyl group, preferably $C_1$-$C_6$ alkyl group, more preferably $C_4$ alkyl group, further preferably by the tert-butyl group.

Amine compounds are another class of antioxidant additives able to be used, optionally in combination with phenolic antioxidant additives. Examples of amine compounds are aromatic amines e.g. aromatic amines of formula $NR^4R^5R^6$ where $R^4$ is an optionally substituted aliphatic group or aromatic group, $R^5$ is an optionally substituted aromatic group, $R^6$ is a hydrogen atom, alkyl group, aryl group or a group of formula $R^7S(O)_zR^8$ where $R^7$ is an alkylene group or alkenylene group, $R^8$ is an alkyl group, alkenyl group or aryl group and z is 0, 1 or 2.

Sulfurized alkyl-phenols or the alkali or alkaline-earth metal salts thereof can also be used as antioxidant additives.

Another class of antioxidant additives is that of copper-containing compounds e.g. copper thio- or dithio-phosphates, the salts of copper and carboxylic acids, dithiocarbamates, sulfonates, phenates, copper acetylacetonates. Copper I and II salts, the salts of succinic acid or anhydride can also be used.

A lubricant composition used in the invention may contain any type of antioxidant additives known to skilled persons.

Advantageously, a lubricant composition used in the invention comprises at least one ash-free antioxidant additive.

A lubricant composition used in the invention may comprise from 0.5 to 2% by weight of at least one antioxidant additive, relative to the total weight of the composition.

In one particular embodiment, a lubricant composition used in the invention is free of an antioxidant additive of aromatic amine type or sterically hindered phenol type.

A lubricant composition suitable for the invention may also comprise at least one detergent additive.

Detergent additives generally allow a decrease in the formation of deposits on the surface of metal parts by dissolving secondary oxidation and combustion products.

The detergent additives able to be used in a lubricant composition of the invention are generally known to skilled persons. Detergent additives can be anionic compounds comprising along lipophilic hydrocarbon chain and hydrophilic head. The associated cation can be a metal cation of an alkali or alkaline-earth metal.

Detergent additives are preferably selected from among alkali metal or alkaline-earth metal salts of carboxylic acids, sulfonates, salicylates, naphthenates, and phenate salts. The alkali and alkaline-earth metals are preferably calcium, magnesium, sodium or barium.

These metal salts generally comprise the metal in stoichiometric amount or in excess, hence in an amount larger than the stoichiometric amount. They are then overbased detergent additives; the excess metal providing the overbased nature to the detergent additive is generally in the form of an oil-insoluble metal salt e.g. a carbonate, hydroxide, oxalate, acetate, glutamate, preferably a carbonate.

A lubricant composition suitable for the invention may comprise for example 2 to 4% by weight of detergent additive relative to the total weight of the composition.

Also, a lubricant composition used in the invention may comprise at least one dispersing agent differing from the compounds of succinimide type defined in the invention.

The dispersing agent can be selected from among Mannich bases, succinimides e.g. of polyisobutylene succinimide type.

A lubricant composition used in the invention may comprise for example from 0.2 to 10% by weight of dispersing agent(s) different from compounds of succinimide type defined in the invention, relative to the total weight of the composition.

A lubricant composition suitable for the invention may also comprise at least one anti-wear and/or extreme pressure additive.

There exists a wide variety of anti-wear additives. Preferably, for the lubricant composition of the invention, the anti-wear additives are selected from among suiflur phosphorus additives such as metal alkylthiophosphates, in particular zinc alkylthiophosphates and more specifically zinc dialkyldithiophosphates or ZnDTP. The preferred compounds have the formula $Zn((SP(S)(OR^2)(OR^3))_2$, where $R^2$ and $R^3$ the same or different are each independently an alkyl group, preferably an alkyl group having 1 to 18 carbon atoms.

Amine phosphates are also anti-wear additives able to be used in a composition of the invention. However, the phosphorus contributed by these additives can act as poison for automotive catalytic systems since these additives generate ash. These effects can be minimised by partially substituting the amine phosphates by additives not contributing phosphorus such as polysulfides, in particular sulfurized olefins.

A lubricant composition suitable for the invention may comprise from 0.01 to 15% by weight, preferably 0.1 to 10% by weight, more preferably 1 to 5% by weight of anti-wear agent(s), relative to the total weight of the composition.

A lubricant composition suitable for the invention may further comprise at least one antifoaming agent different from the polyorganosiloxane additive defined in the present invention.

The antifoaming agent can be selected from among polyacrylates or waxes.

A lubricant composition suitable for the invention may comprise from 0.01 to 2% by weight or 0.01 to 5% by weight, preferably 0.1 to 1.5% by weight or 0.1 to 2% by weight of antifoaming agent, relative to the total weight of the composition.

A lubricant composition suitable for the invention may also comprise at least one pour point depressant (PPD).

By slowing the formation of paraffin crystals, pour point depressants generally improve cold temperature properties of the composition. As examples of pour point depressant additives, mention can be made of alkyl polymethacrylates, polyacrylates, polyarylamides, polyalkylphenols, polyalkylnaphthalenes, alkylated polystyrenes.

In terms of formulation of said lubricant composition, said air release additive(s) can be added to a base oil or mixture of base oils, after which the other additional additives can be added.

Alternatively, said air release additive(s) can be added to a conventional pre-existing lubricant formulation comprising in particular one or more base oils, one or more additional additives.

Alternatively said air release additive(s) of the invention can be combined with one or more additional additives and the «package» of additives thus formed added to a base oil or mixture of base oils.

Lubricant Composition Used in the Invention

Advantageously, a lubricant composition used in the invention has kinematic viscosity, measured at 100° C. according to standard ASTM D445, ranging from 4 to 50 $mm^2/s$, in particular ranging from 5 to 40 $mm^2/s$.

Advantageously, a lubricant composition used in the invention has kinematic viscosity, measured at 40° C. according to standard ASTM D445, ranging from 3 to 450 $mm^2/s$, in particular from 10 to 400 $mm^2/s$, de preferably ranging from 15 to 70 $mm^2/s$.

In one advantageous embodiment of the present invention, the values of electrical resistivity measured at 90° C. of the lubricant compositions used in the invention are between 5 and 10000 Mohm·m, preferably between 6 and 5000 Mohm·m.

In one advantageous embodiment of the present invention, the values of dielectric loss measured at 90° C. of the lubricant compositions used in the invention are between 0.01 and 30, preferably between 0.02 and 25, more preferably between 0.02 and 10.

Advantageously, the grade of a lubricant composition used in the invention according to the SAEJ300 classification can be defined by the formula (X)W(Y), where X is 0 or 5; and Y is an integer ranging from 4 to 20, in particular ranging from 4 to 16 or from 4 to 12.

In one particular embodiment, a lubricant composition used in the invention comprises, or even is constituted by:

- a base oil or mixture of base oils preferably selected from among polyalphaolefins (PAOs), polyalkylene glycols (PAGs), the esters of carboxylic acids and alcohols, Group II base oils and Group III base oils preferably selected from among polyalphaolefins (PAOs), and base oils in Group III;
- one or more polyorganosiloxanes, preferably selected from among polyalkylsioxanes such as polydimethylsiloxanes;
- optionally, one or more additional additives selected from among friction modifiers, viscosity index improvers, detergents, dispersants, anti-wear and/or extreme pressure additives, antioxidants, pour point depressants, antifoaming agents and mixtures thereof.

In one particular embodiment, a lubricant composition used in the invention comprises, or even is constituted by:

- from 0.0005% to 2% by weight, preferably 0.001 to 1.5% by weight, more preferably from 0.002 to 1% by weight of polyorganosiloxane(s), preferably polydimethylsiloxane(s);
- at least 70% by weight, preferably 80 to 99.95% by weight of base oil(s) preferably selected from among polyalphaolefins (PAOs), polyalkylene glycols (PAGs), the esters of carboxylic acids and alcohols, Group III base oils and Group III base oils, more preferably from among polyalphaolefins (PAOs). Group II base oils and Group III base oils:
- optionally from 0.1 to 5% by weight of one of more additives selected from among friction modifiers, viscosity index improvers, detergents, dispersants, anti-wear and/or extreme pressure additives, antioxidants, pour point depressants, antifoaming agents and mixtures thereof: the contents being expressed relative to the total weight of said lubricant composition.

Applications

The subject of the invention is the use of at least one polyorganosiloxane for air release from a lubricant composition comprising at least one base oil, when lubricating at least one moving part of a vehicle.

In the meaning of the present invention, «air release» designates the action whereby the volume of air present in the lubricant composition can be reduced. Air release is to be distinguished from defoaming which targets reducing foam on the surface of the lubricant composition.

In the present invention, by «moving part», it is meant a part which may be a rotating part.

In one embodiment of the invention, the moving part is a rotating part, typically at a speed ranging from 1000 to 15000 rpm, preferably ranging from 1300 to 12000 rpm, more preferably from 5000 to 10000 rpm.

In one embodiment of the invention, the rotating part is a pinion of a gearbox.

The inventors have discovered that polyorganosiloxanes allow a significant reduction in air volume in the core of a lubricant composition when said lubricant composition is in movement, for example when used to lubricate parts which may be subjected to high rotation speeds.

More particularly, organosiloxane allows an acceleration in the air release process of the lubricant composition.

In one embodiment, the initial variation of air volume of the lubricant composition used in the invention, measured according to standard NF ISO 12152 (2012), is lower than or equal to 6%, preferably lower than or equal to 5% and/or the volume variation of air after 1 min standing time of the lubricant composition used in the invention, measured according to standard NF ISO 12152 (2012), is lower than or equal to 4%, preferably lower than or equal to 3%, more preferably lower than or equal to 2%.

In one embodiment of the invention, the lubricant composition is applied to lubricate at least one element selected from among a gearbox, transmission, motor, reducer.

Therefore, in one preferred embodiment of the invention, the lubricant composition is used to lubricate a propulsion system of an electric or hybrid vehicle, in particular at the reducer.

Advantageously, the lubricant composition is used to lubricate the different parts of a propulsion system of an electric or hybrid vehicle, in particular the bearings positioned between the rotor and stator of an electric motor and/or the transmission, in particular the reducer, in an electric or hybrid vehicle.

In one embodiment, the polyorganosiloxane(s) used in the invention allow a reduction in losses through bubbling in a lubrication system of a vehicle, preferably an electric or hybrid vehicle. Typically, the polyorganosiloxane(s) used in the invention allow a reduction of at least 10% or even at least 15% in losses through bubbling.

Losses through bubbling typically correspond to power losses via dragging of a part in movement, typically in rotation, in a bath of lubricant composition.

In one embodiment, the polyorganosiloxane(s) used in the invention allow an increase in vehicle yield.

In another aspect, the invention therefore concerns the use of a lubricant composition comprising at least one base oil and at least one polyorganosiloxane, in a lubricating system of moving parts of a vehicle, to increase the yield of said vehicle.

All the characteristics and preferences described for the lubricant composition used in the invention, Including the polyorganosiloxane(s), and uses thereof also apply to this use to increase yield.

In another aspect, the invention further concerns a method to release air from a lubricant composition used to lubricate at least one moving part of a vehicle, said method comprising the use of at least one polyorganosiloxane in said lubricant composition.

In one embodiment, the air release method typically comprises a step at which the lubricant composition is placed in contact with a part intended to be set in movement in said vehicle.

Therefore, in one particular embodiment of the invention, the air release method is applied in a lubricant composition intended to lubricate the propulsion system of an electric or hybrid vehicle, in particular the bearings positioned between the rotor and stator of an electric motor; and/or the transmission, in particular the reducer.

All the characteristics and preferences described for the lubricant composition employed in the invention, including the polyorganosiloxane(s), and uses thereof also apply to this air release method.

In one aspect, the invention also concerns a method for reducing losses through bubbling in a lubrication system of a vehicle propulsion system, preferably an electric or hybrid vehicle, said method comprising the contacting of a lubricant composition comprising at least one base oil and at least one polyorganosiloxane with at least one part of the propulsion system of said vehicle.

Typically, the method for reducing losses through bubbling comprises a step at which loss through bubbling is preferably reduced by at least 10%, advantageously by at least 15 All the characteristics and preferences described for the lubricant composition used in the invention, including the polyorganosiloxane(s), and uses thereof also apply to this method for reducing losses through bubbling.

In the invention, the particular, advantageous or preferred characteristics of the composition of the invention allow the defining of uses of the invention which are also particular, advantageous or preferred.

The Invention is now described by means of the following examples evidently given as illustrations not limiting the invention.

EXAMPLES

Example 1

Lubricant Compositions were Prepared with the Following Ingredients:

- Base oil: Polyalphaolefin having dynamic viscosity at 100° C. of 40 $mm^2/s$ and at 40° C. of 400 $mm^2/s$;
- Polyorganosiloxane: polydimethylsiloxane at 4% by weight of active material in a hydrocarbon solvent base;
- Additive package used in transmission applications and particularly comprising an anti-wear and extreme pressure additive, an antioxidant, corrosion inhibitor, dispersant.

A base oil of high viscosity was used in this example having regard to the relatively low rotation speed used in this standardized test.

Table 2 below groups together the tested compositions, percentages being expressed in weight % relative to the total weight of the composition.

TABLE 2

| | CC1 | CC2 | Inv1 | Inv2 | Inv3 |
|---|---|---|---|---|---|
| Base oil | 100% | 98% | 99.8% | 99.95% | 97.8% |
| Polyorganosiloxane | — | — | 0.2% | 0.05% | 0.2% |
| Additive package | — | 2% | — | — | 2% |

The compositions in Table 2 were used in accordance with standard NF ISO 12152 (2012) to determine the air release of the compositions. The principle of the test is the following: a set of gears is set in rotation in the test lubricant at constant speed (rotation speed of 1400 rpm and tangential velocity of 4 m/s) at a defined oil temperature for a fixed period of time (30° C. in this example). After engine switch-off, the volume increase of the test lubricant is determined by distinguishing between oil-air dispersion and surface foam.

Throughout this test, the set of gears immersed up to the middle of tooth width entrains air into the lubricant composition as it rotates. This entrained air in the form of bubbles spontaneously reaches the outside due to Archimedes' thrust. Therefore, during the rotation phase, there is continuously an aeration/air release equilibrium.

Consequently, observation of a decrease in initial air implies acceleration of the air release process.

FIG. 1 shows the change in oil-air dispersion over time, initially with the value at 0 min and up to 5 minutes.

As shown by the results in FIG. 1, the use of a polyorganosiloxane allows release of air from the lubricant composition, in particular the polyorganosiloxane allows acceleration of the air release process of the lubricant composition. In particular, the lubricant compositions Inv1, inv2 and Inv3 show an initial air change of 4%, whereas the lubricant compositions CC1 and CC2 not containing polyorganosiloxane show an initial air change of 8%. It is to be noted that air release by the polyorganosiloxane additive is not perturbed by the presence of the additive package (Composition Inv3) conventionally used in lubricant compositions for transmission applications.

Example 2

Lubricant Compositions were Prepared with the Following Ingredients:

Base oil: Group III base oil having dynamic viscosity at 100° C. of 8 $mm^2/s$ and at 40° C. of 44 $mm^2/s$;

Polyorganosiloxane: polydimethylsiloxane at 4 weight % of active material in a hydrocarbon solvent base.

A base oil of lower viscosity was used in this example having regard to the higher rotation speed used in this test.

Table 3 below groups together the test compositions, percentages being expressed in weight % relative to the total weight of the composition.

TABLE 3

| | CC3 | Inv4 |
|---|---|---|
| Base oil | 100% | 99.95% |
| Polyorganosiloxane | — | 0.05% |

Loss through bubbling was determined for these compositions CC3 and Inv4 on a test rig illustrated in FIG. 2. The rig was composed of an electric motor driving a drive shaft in rotation via a toothed belt drive (maximum speed of 7150 rpm). At the end of this drive shaft, a pinion was positioned rotating in the oil bath allowing the phenomenon of bubbling to be obtained. It is possible to test several types of gearing at different speeds and immersions in the oil bath. Heat strips positioned underneath the oil sump allow tests to be performed with temperature rises of up to 150° C. The temperature of the fluid was given by a thermocouple immersed in the bath.

A torquemeter (accuracy of ±0.002 N·m) positioned on the drive shaft allowed measurement of drag torque, and by means of the rotation speed it was possible to determine the power dissipated by bubbling. Friction torques of the bearings were subtracted from the torque measured by the sensor to obtain only the power dissipated by bubbling.

The shaft rotation speed was 6000 rpm, the chosen pinion had a pitch radius of 79.5 mm, which gave a tangential velocity of 50 m/s. The chosen pinion had a 3 mm module and the test was conducted with relative immersion of 0.5, relative immersion corresponding to immersion at mid-height/mid-width of the pinion.

FIG. 3 illustrates loss through bubbling in Watts as a function of temperature (in ° C.) for both tested compositions.

As shown by the results in FIG. 3, the use of a polyorganosiloxane allows a reduction in losses through bubbling, in particular the polyorganosiloxane allows a decrease in losses through bubbling of about 20% at between 40 and 70° C., and even higher after 80° C.

To conclude from these two examples, it is to be pointed out that acceleration of air release allowed by addition of the polyorganosiloxane additive has two positive effects. First, as illustrated in Example 1, a reduction is observed in the volume of air dispersion in the lubricant composition by means of this additive, which implies a reduction in hydrodynamic drag, hence the reduction in losses through bubbling of 20% ascertained at between 40 and 70° C. Secondly, this reduction in air quantity also allows preventing of a critical sharp rise in losses through bubbling at 80° C., hence the fact that losses through bubbling of the formulation containing the additive (Inv4) display a constant slope with temperature.

Example 3

Lubricant Compositions were Prepared with the Following Ingredients:

Base oil: Group Ill base oil having dynamic viscosity at 100° C. of 4 $mm^2/s$:

Polyorganosiloxane A: polydimethylsioxane at 4 weight % active material in a hydrocarbon solvent base, also containing 5% by weight of solid silica;

Polyorganosiloxane B: polydimethylsiloxane at 4 weight % active material in a hydrocarbon solvent base.

Table 4 below groups together the tested compositions, percentages being expressed in weight % relative to the total weight of the composition.

TABLE 4

| | CC4 | Inv5 | Inv6 |
|---|---|---|---|
| Base oil | 100% | 99.95% | 99.95% |
| Polyorganosiloxane A | — | 0.05% | — |
| Polyorganosiloxane B | — | — | 0.05% |

The loss through bubbling of these compositions was determined in the same manner as in Example 2, over a wider temperature range (from 20 to 100° C.).

FIG. 4 shows loss through bubbling in Watts as a function of temperature (in ° C.) for the tested compositions.

As shown by the results in FIG. 4, the use of a polyorganosiloxane in an oil allows a reduction in losses through bubbling, compared with this same oil devoid of polyorganosiloxane, this reduction being even more pronounced at high temperature on and after 60° C., and even more so on and after 80° C.

Air quantity was determined at different temperatures following the method described in Example 1. In this example only «initial» air variation was determined.

FIG. 5 shows the air release of the tested compositions as a function of temperature. As shown by the results in FIG. 5, the addition of polyorganosiloxane to an oil allows a highly significant reduction in air quantity in the resulting lubricant composition, compared with this same oil devoid of polyorganosiloxane.

The invention claimed is:

1. A method to release air from a lubricant composition, the method comprising lubricating at least one moving part in a propulsion system of an electric or hybrid vehicle with the lubricant composition comprising at least one base oil, the method further comprises the use of at least one polyorganosiloxane in the lubricant composition, wherein said at least one moving part is a part rotating at a speed ranging from 1000 to 15000 rpm.

2. The method according to claim 1, wherein the lubricant composition exhibits an initial variation in air volume in the lubricant composition, measured according to standard NF ISO 12152, lower than 6%.

3. The method according to claim 2, wherein the lubricant composition exhibits an initial variation in air volume in the lubricant composition, measured according to standard NF ISO 12152, lower than 5%.

4. The method according to claim 1, wherein said polyorganosiloxane is selected from polydimethylsiloxanes.

5. The method according to claim 1, wherein the lubricant composition comprises from 0.0005 to 2% by weight of polyorganosiloxane(s), relative to the total weight of the lubricant composition.

6. The method according to claim 5, wherein the lubricant composition comprises from 0.001 to 1.5% by weight of polyorganosiloxane(s), relative to the total weight of the lubricant composition.

7. The method according to claim 1, wherein the base oil(s) have kinematic viscosity at 100° C. ranging from 4 to 50 $mm^2/s$.

8. The method according to claim 1, wherein the lubricant composition comprises at least 70% by weight of one or more base oils, relative to the total weight of the lubricant composition.

9. The method according to claim 8, wherein the lubricant composition comprises 80 to 99% by weight of one or more base oils, relative to the total weight of the lubricant composition.

10. The method according to claim 1, comprising a step wherein bubbling losses in a lubrication system of the vehicle are reduced.

11. The method according to claim 1, wherein a lubrication system comprises at least one element selected from the bearings positioned between the rotor and stator of an electric motor and the transmission, of an electric or hybrid vehicle.

12. The method according to claim 1, comprising a step wherein air is released from the lubricant composition.

13. The method according to claim 1, wherein the step comprising the use of at least one polyorganosiloxane comprises a step of mixing the at least one polyorganosiloxane with the at least one base oil.

14. The method according to claim 1, wherein said at least one moving part is a part rotating at a speed ranging from 1300 to 12000 rpm.

15. The method according to claim 1, wherein said at least one moving part is a part rotating at a speed ranging from 5000 to 15000 rpm.

16. A method for reducing losses through bubbling in a lubrication system of an electric or hybrid vehicle propulsion system, the method comprising contacting a lubricant composition comprising at least one base oil and at least one polyorganosiloxane with at least one moving part of the propulsion system of the electric or hybrid vehicle, wherein said at least one moving part is a part rotating at a speed ranging from 1000 to 15000 rpm.

17. The method according to claim 16, comprises a step at which loss through bubbling is reduced by at least 10%.

18. The method according to claim 16, wherein the polyorganosiloxane is selected from polydimethylsiloxanes.

19. The method according to claim 16, wherein the at least one moving part is a part rotating at a speed ranging from 5000 to 15000 rpm.

20. The method according to claim 16, wherein a lubrication system comprises at least one element selected from the bearings positioned between the rotor and stator of an electric motor and the transmission, of the electric or hybrid vehicle.

* * * * *